US005205431A

United States Patent [19]

Zinnbauer

[11] Patent Number: 5,205,431

[45] Date of Patent: Apr. 27, 1993

[54] COSMETIC CASE

[75] Inventor: Gerald B. Zinnbauer, Charlotte, N.C.

[73] Assignee: The Procter & Gamble Company, Cincinnati, Ohio

[21] Appl. No.: 732,275

[22] Filed: Jul. 18, 1991

[51] Int. Cl.[5] ..... B65D 45/16

[52] U.S. Cl. ..... 220/326; 220/4.22; 220/264; 220/281; 220/283; 220/343; 206/235; 206/581; 132/293

[58] Field of Search ..... 220/4.22, 4.24, 281, 220/282, 283, 324, 326, 263, 264, 335, 343, 338; 206/235, 581; 132/293, 294, 301

[56] References Cited

U.S. PATENT DOCUMENTS

| | | | |
|---|---|---|---|
| 1,709,182 | 4/1929 | McKnight et al. | 220/264 |
| 1,860,131 | 5/1932 | Booth | 220/264 X |
| 2,733,830 | 2/1956 | Ruskin | 220/338 |
| 3,308,835 | 3/1967 | Silverberg | 220/263 |
| 3,885,715 | 5/1975 | Lowry | 222/182 |
| 3,927,796 | 12/1975 | Whitehouse | 220/281 |
| 3,968,880 | 7/1976 | Ostrowsky | 220/281 X |
| 4,042,105 | 8/1977 | Taylor | 220/281 X |
| 4,043,448 | 8/1977 | Tanaka | 220/281 X |
| 4,061,817 | 12/1977 | Maxel . | |
| 4,118,616 | 10/1978 | Wittkamp et al. | 206/387 |
| 4,209,100 | 6/1980 | Uhlig | 215/216 |
| 4,220,262 | 9/1980 | Uhlig et al. | 222/153 |
| 4,584,425 | 4/1986 | Tom . | |
| 4,602,719 | 7/1986 | Borst | 220/263 |
| 4,799,503 | 1/1989 | Tahara | 220/260 |
| 4,809,868 | 3/1989 | Pomroy | 220/260 |
| 4,860,920 | 8/1989 | Quennessen | 220/326 |
| 4,901,882 | 2/1990 | Goncalves | 220/324 |
| 4,930,528 | 6/1990 | Hatakeyama | 132/301 |
| 4,972,860 | 11/1990 | Yuhara et al. | 220/263 X |
| 5,048,715 | 9/1991 | Wolff | 220/335 |
| 5,050,623 | 9/1991 | Yuhara et al. | 132/301 |

FOREIGN PATENT DOCUMENTS

| | | | |
|---|---|---|---|
| 0006242 | 1/1980 | European Pat. Off. | 220/263 |
| 2471326 | 6/1981 | France . | |

*Primary Examiner*—Allan N. Shoap
*Assistant Examiner*—Stephen Cronin
*Attorney, Agent, or Firm*—Kevin C. Johnson; E. Kelly Linman; Michael E. Hilton

[57] ABSTRACT

A case for cosmetics including a cover and a base. The cover and base have end and peripheral walls which together define an interior compartment. An integrally formed latching device is located in the front portion of the case. The latching device comprises a push tab in the form of a tongue-like section of the base peripheral wall. The distal and intermediate portions of the push tab are separated from adjacent portions of the base peripheral wall by at least one slot which extends alongside the push tab to its proximal end. Coacting cam means associated with the push tab and with an adjacent portion of the cover produces a force biasing the front portion of the base and cover apart when the push tab is moved inwardly with the latch engaged. Interengagement means is integrally formed on the cover and base peripheral walls to latch the cover to the base when the front portions of the base and cover are pressed together and unlatch when the front portions of the base and cover are forced apart.

5 Claims, 4 Drawing Sheets

COSMETIC CASE

FIELD OF THE INVENTION

The present invention relates to cosmetic cases, and more particularly, to such cases having a push button for disengaging the latch securing the cover and the base in closed condition.

BACKGROUND INFORMATION

Cosmetic cases having a base and a cover connected to one another by a hinge located in the rear portion of the case have been available for many years. The hinge may be of any design that makes it possible for the cover to pivot or rotate with respect to the base when the cosmetic case is opened and closed. Typically, a closure or latching device is provided in the front portion of the cosmetic case. The ability to open these cosmetic cases with a convenient and easy-to-use push button has long been an important goal of those skilled in the art. One way to accomplish this goal is to use a separate or independent push button.

Cosmetic cases having separate or independent push buttons for disengaging the engagement between the cover and the base are disclosed in U.S. Pat. No. 4,799,503 issued to Tahara on Jan. 24, 1989, and U.S. Pat. No. 4,901,882 issued to Goncalves on Feb. 20, 1990. These two prior art cosmetic cases have the advantage of a convenient and easy-to-use push button for disengaging the cover and the base. However, they have the disadvantage of requiring the additional step of properly positioning the separate or independent push button in the cosmetic case during assembly, thereby increasing both the time to manufacture and the final cost of the cosmetic case.

Accordingly, it is an object of the present invention to provide a cosmetic case having a push button for disengaging the cover and the base and requiring no additional steps to assemble;

It is further an object of the present invention to provide a cosmetic case in which the parts permitting push button operation are integrally molded with the cover and the base;

It is further an object of the present invention to provide a cosmetic case in which the push button opening device has excellent durability;

It is further an object of the present invention to provide a cosmetic case having a push button made of a resilient material able to withstand the required flexing for disengaging the engagement between the cover and the base;

It is further an object of the present invention to provide a cosmetic case having a push button opening device and which requires reduced assembly time; and It is lastly an object of the present invention to provide a cosmetic case that accomplishes the aforementioned objectives at minimal costs.

SUMMARY OF THE INVENTION

In accordance with one aspect of the present invention a case for cosmetics is provided. The case includes a cover and a base. The cover and base have end and peripheral walls which together define an interior compartment. The peripheral walls have front and rear portions. A hinge associated with the rear portions of the base and cover peripheral walls rotatably mounts the cover on the base. A latching device is located in the front portion of the case. The latching device comprises a push tab in the form of a tongue-like section of the base peripheral wall. The distal and intermediate portions of the push tab are separated from adjacent portions of the base peripheral wall by at least one slot which extends alongside the push tab to its proximal end. A coacting cam means associated with the push tab and with an adjacent portion of the cover produce a force biasing the front portion of the base and cover apart when the push tab is moved inwardly with the latch engaged. An interengagement means integrally formed on the cover and base peripheral walls for latching the cover to the base when the front portions of the base and cover are pressed together and for unlatching the cover from the base when the front portions of the base and cover are forced apart.

BRIEF DESCRIPTION OF THE DRAWINGS

While the specification concludes with claims which particularly point out and distinctly claim the invention, it is believed that the present invention will be better understood from the following description of preferred embodiments, taken in conjunction with the accompanying drawings, in which like reference numerals identify identical elements and wherein:

DESCRIPTION OF THE PREFERRED EMBODIMENT

Figure 1:
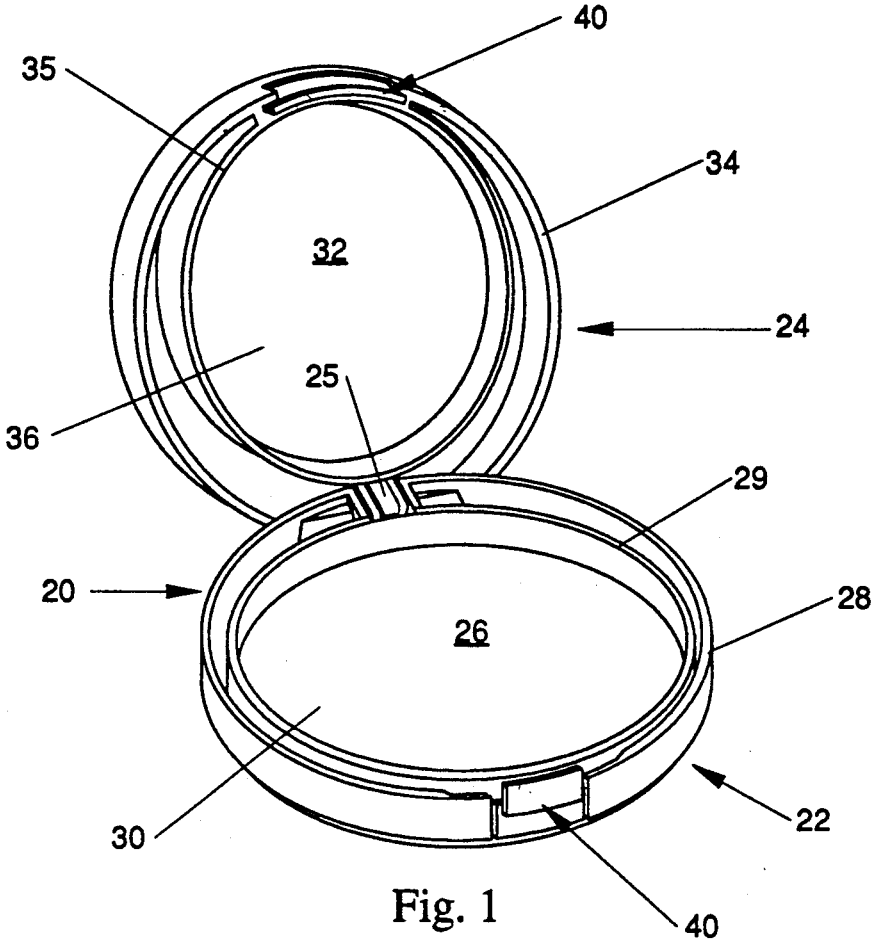
FIG. 1 is a perspective view of a preferred embodiment of the cosmetic case of the present invention, in an open condition with the cover raised.
Figure 2:
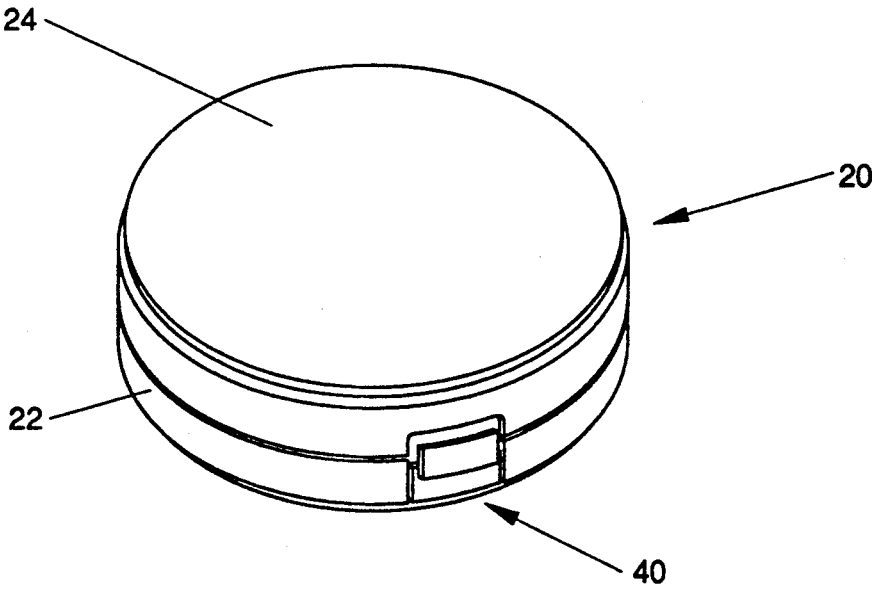
FIG. 2 is a perspective view of the cosmetic case of FIG. 1, in a closed condition.

In a particularly preferred embodiment, seen in FIGS. 1 and 2, the present invention provides a cosmetic case indicated generally as 20. The cosmetic case 20 includes a generally circular base 22 and a generally circular corresponding cover 24. The circular base 22 and the corresponding circular cover 24 can have an outside diameter of about 73 mm. The base 22 has a bottom end wall 26 and a peripheral wall 28 which together define an interior compartment 30. The base end wall 26 preferably has a thickness of about 1.65 mm. The base peripheral wall 28 preferably has a thickness of about 2.0 mm in the front or latch area. The base peripheral wall 28 preferably has a height of about 7.8 mm. The base 22 preferably includes an inner generally circular wall 29 for containing face powder, compact face powder, foundation powder, eye shadow, blushes and the like. The cover 24 has a top end wall 32 and a peripheral wall 34 which together define an interior compartment 36. The cover end wall 32 preferably has a thickness of about 1.65 mm. The cover peripheral wall 34 preferably has a thickness of about 2.0 mm in the front or latch area. The cover peripheral wall 34 preferably has a height of about 7.8 mm. The cover 24 preferably includes an inner generally circular wall 35 for containing a mirror or reflecting device. The rear portion of cover 24 is rotatably mounted on the rear portion of the peripheral wall 28 of the base 22 by a hinge 25. The hinge 25 preferably includes a pin about which the base 22 and the cover 24 rotate or pivot. However, the hinge 25 may be of any design that makes it possible for the cover 24 to rotate or pivot with respect to the base 22.

Figure 3:
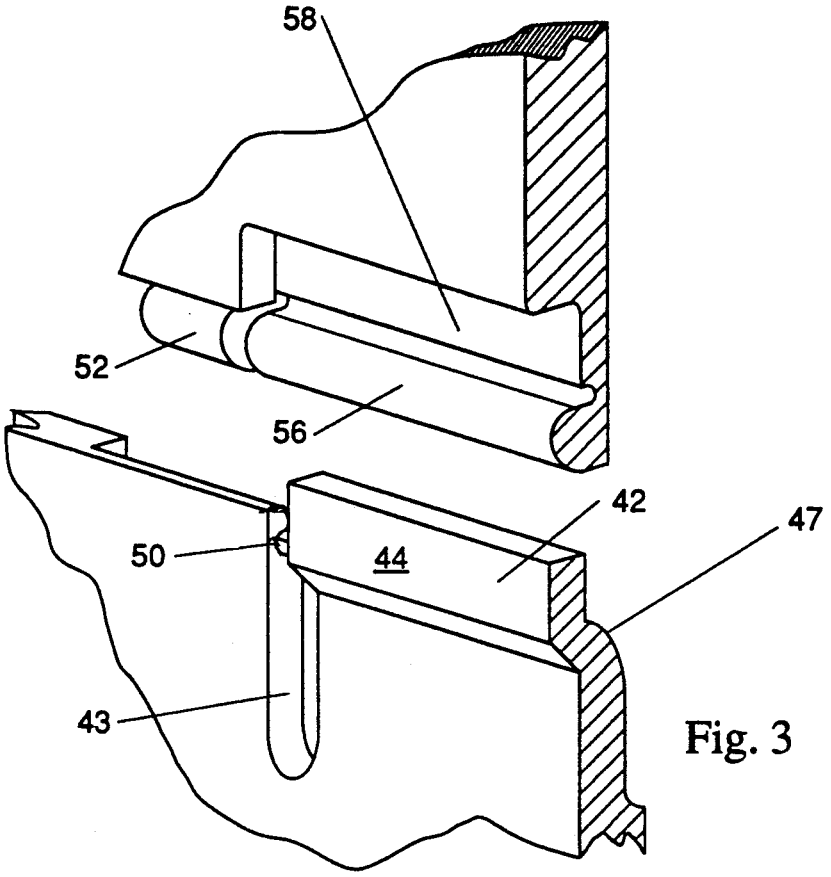
FIG. 3 is an enlarged, fragmentary, perspective view of the push button and latch of the cosmetic case, with the cover in a partially open condition.

A latching device 40 is located in the front portion of both the base 22 and the cover 24 of the cosmetic case 20. The latching device 40 includes several components which provide the opening and locking/securing functions for the cosmetic case 20. The components that comprise latching device 40 are shown in detail in FIGS. 3, 4, and 5. The main component of the latching device 40 is the push tab 42. The push tab 42 is in the form of a tongue-like section of the base peripheral wall 28. At the distal end of the push tab 42 is a pushing surface 44. The pushing surface 44 preferably has a thickness of about 0.76 mm. At its proximal end, the push tab 42 is approximately at the level of the base bottom end wall 26 inner surface. A core slot 43 extends along each side of the push tab 42 to its proximal end, separating the distal and intermediate portions of the push tab 42 from the adjacent portions of the base peripheral wall 28. The separation of the distal and intermediate portions of the push tab 42 from the adjacent portions of the base peripheral wall 28 by the core slot 43 permits the inward movement of the push tab 42. The push tab 42 preferably has a thickness of about 0.85 mm in the proximal area when the tab 42 is about 10.3 mm in height and 20 mm in width. The thickness of push tab 42 is less than the thickness of the base peripheral wall 28 to reduce the resistance to the inward movement or flexing of the push tab 42. Located at the proximal end of the push tab 42 adjacent the base bottom end wall 26 is a radius 46. The radius 46 reduces the possibility of a stress fracture occurring during the inward flexing of the push tab 42.

A tab cam 47 is provided on the push tab 42. Cam 47 preferably is of a generally arcuate shape with the arc's convex surface facing toward the cover 24. Cam 47 is adapted to coact with quick release cam 56, described below, to produce a force biasing the front portion of the base 22 and the cover 24 apart when the push tab 42 is moved inwardly. The biasing force produced by the cam 47 disengages the base 22 and the cover 24 of case 20.

A pair of base catch indentations 50 are cut into the interior surface of the base peripheral wall 28, one alongside each core slot 43. Indentations 50 are preferably about 6.36 mm in length, 1.0 mm in height and 0.5 mm in depth. A pair of cover catch protrusions 52 extend below the cover peripheral wall 34 and are aligned to engage with the base catch indentations 50. Protrusions 52 preferably have a length of about 5.7 mm, a height of 1.16 mm and protrude 0.58 mm. The engagement between indentations 50 and protrusions 52 latches the cosmetic case 20 in its closed condition, seen in FIG. 2. While in its closed condition the interference between indentations 50 and protrusions 52 is about 0.45 mm.

Extending below the cover peripheral wall 34 and between the protrusions 52 is quick release cam 56. As stated previously, quick release cam 56 interacts with the tab cam 47, producing a force biasing the front portion of the base peripheral wall 28 and the cover peripheral wall 34 apart when push tab 42 is moved inwardly while indentations 50 and protrusions 52 are engaged. Push tab run-out depression 58 is located directly above quick release cam 6, providing a recess in the cover peripheral wall 34 into which the push tab 42 can project when it is pressed inwardly. It should be sized accordingly.

In a preferred execution of the cosmetic case 20 of the present invention the elements of the cosmetic case 20 will have the dimensions previously mentioned. It is understood, however, that these dimensions are closely related and that if the dimensions of one element are changed substantially, corresponding dimensional changes may have to be made in the others.

Figure 4:
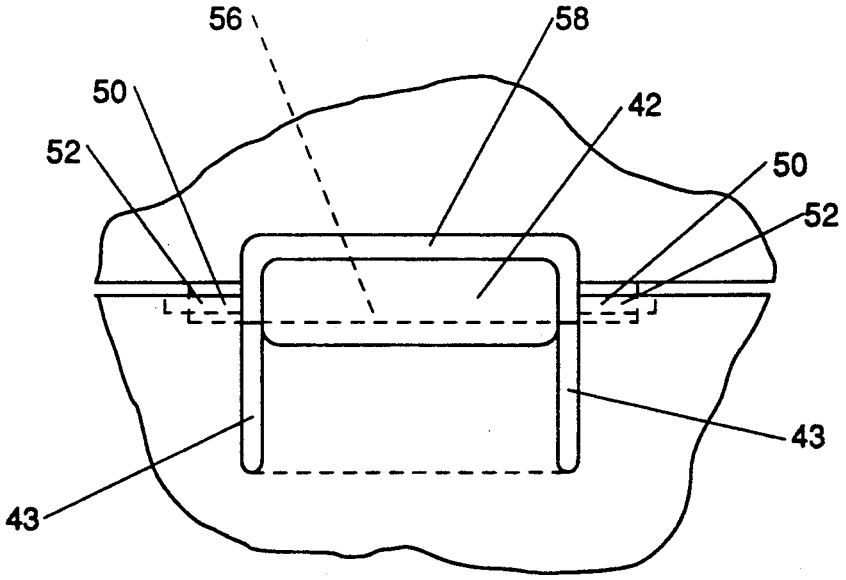
FIG. 4 is an enlarged, fragmentary, front elevation view of the push button and latch of the cosmetic case, with the cover in a closed condition.
Figure 5:
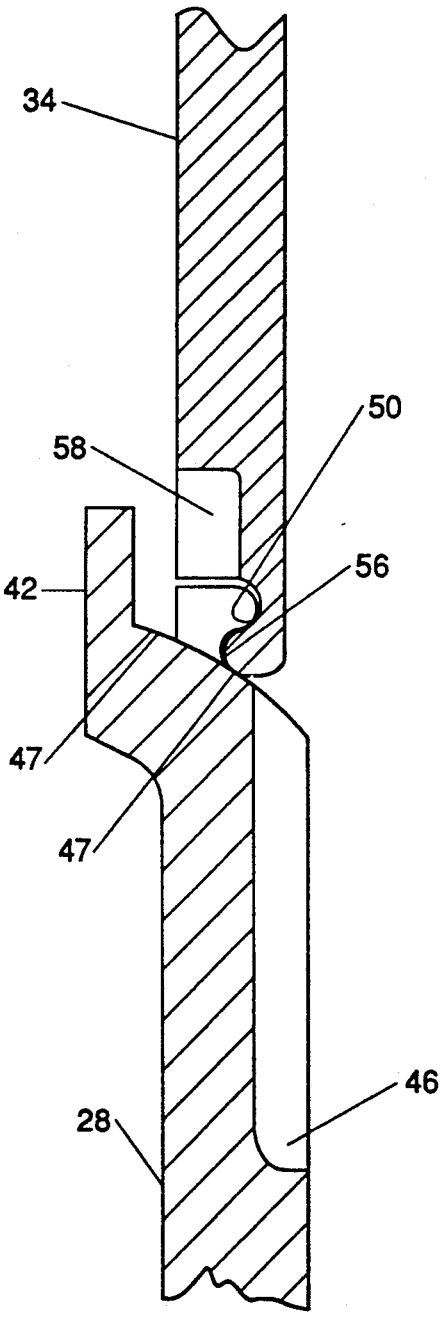
FIGS. 5 through 7 are enlarged, sequential, fragmentary, cross-sectional views of the push button of the cosmetic case as it is utilized in opening the cosmetic case.

The operation of the cosmetic case 20 will now be described. As shown in FIGS. 2, 4, and 5, when cosmetic case 20 is in its closed condition, the protrusions 52 are engaged with the indentations 50. Also when the cosmetic case 20 is in its closed condition the tab cam 47 is in contact with the quick release cam 56. When the cosmetic case 20 is in its closed condition the contact between the tab cam 47 and the quick release cam 56 is minimal such that no force exists biasing the front portion of the base 22 and the cover 24 apart.

Figure 6:
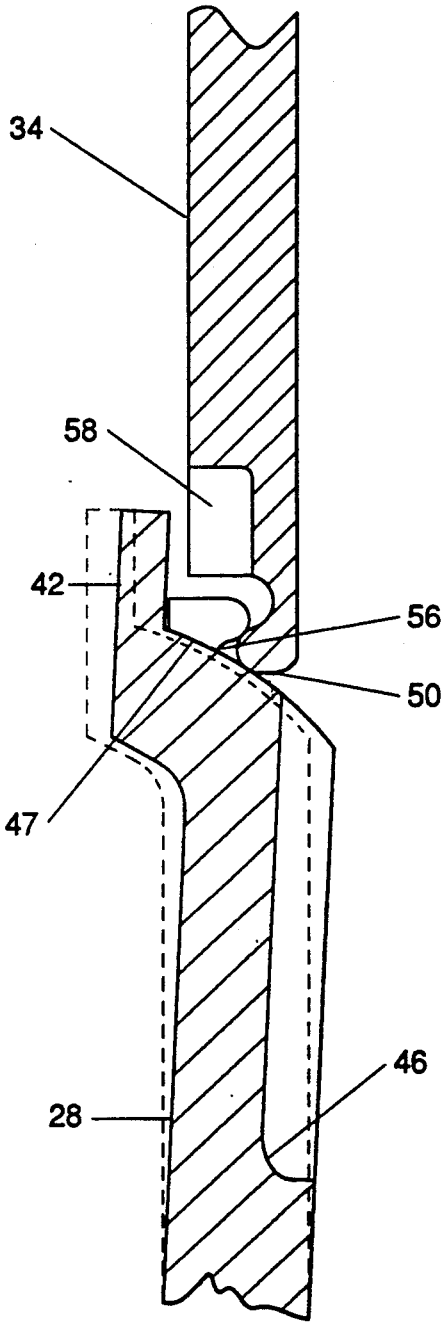
Figure 7:
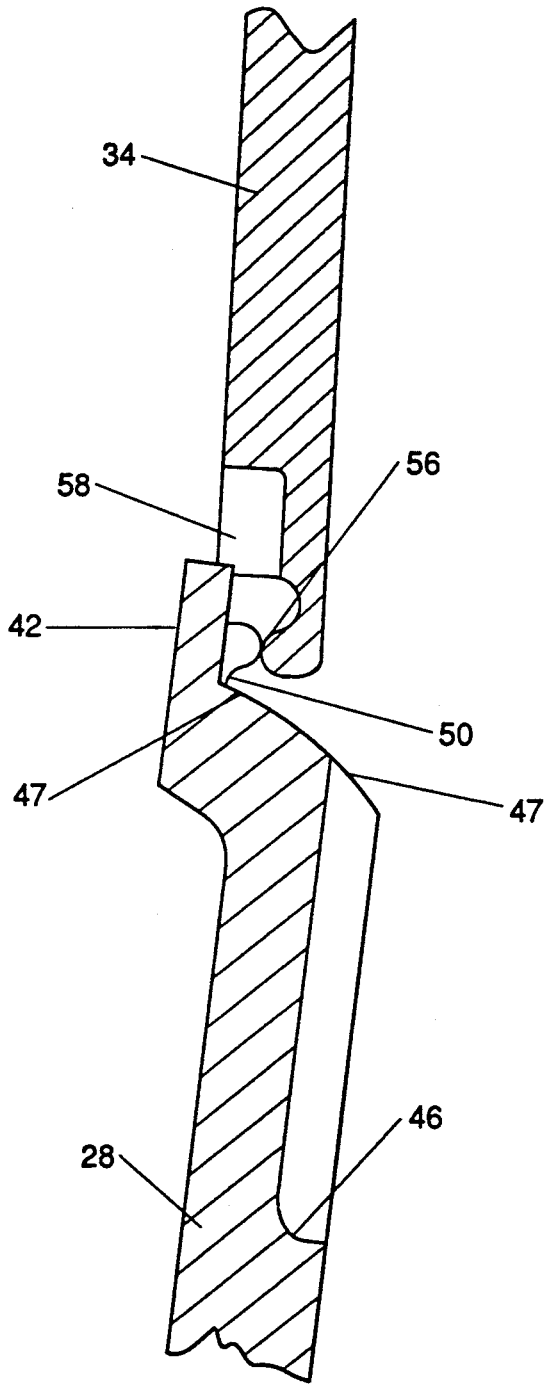

To open the cosmetic case 20, the pushing surface 44 of the push tab 42 is pressed inwardly. As shown in FIGS. 6 and 7, when the pushing surface 44 of the push tab 42 is pressed inwardly, the tab cam 47 engages with cam 56 in a continually increasing interference providing a force biasing the front portions of the base peripheral wall 28 and the cover peripheral wall 34 apart until protrusions 52 are disengaged from indentations 50. A pushing force in the range of about 4 pounds to 6 pounds is required to disengage the protrusions 52 from the indentations 50. During disengagement, the front portion of base peripheral wall 28 flexes outwardly, and to a greater degree protrusions 52 flex inwardly as protrusions 52 disengage from indentations 50. Upon disengagement of protrusions 52 from indentations 50, the front portion of the cover 24 is separated from the front portion of the base 22 as they rotate or pivot about the hinge 25. The inward movement or flexing of the push tab 42 is permitted because of its separation from the base peripheral wall 28 by the core slots 43. In addition, the inward flexing of the push tab 42 is made easier by the reduced thickness of the push tab 42 at the proximal end of the push tab 42, creating less resistance to the inward flexing of the push tab 42. To assist in their engagement with and disengagement from the indentations 50, the protrusions 52 have a beveled bottom surface which can be seen in FIG. 3. The beveled bottom surfaces of protrusions 50 preferably are of a generally arcuate shape with the arc's convex surface facing toward the base 22. This beveled bottom surface on the protrusions 52 provides a lead-in surface facilitating the engagement between the protrusions 52 and the indentations 50. In addition, the beveled bottom surfaces on the protrusions 52 facilitate the quick opening of the cosmetic case 20, since the material which was removed in forming the surfaces could only have caused additional and prolonged interference during disengagement. The tab run-out depression 58 located directly above the quick release cam 56 is the void or cavity in the cover peripheral wall 34 that permits the inward flexing or movement of the push tab 42 until the protrusions 52 are disengaged from the indentations 50.

When closing the cosmetic case 20, the cover 24 and the base 22 are brought together as they rotate or pivot about the hinge 25 until protrusions 52 engage with indentations 50. Engagement between protrusions 52 and indentations 50 is facilitated by the beveled bottom surfaces on the protrusions 52. While protrusions 52 and indentations 50 are engaged, the tab cam 47 and quick release cam 56 are in minimal contact with one another. With the cosmetic case 20 in its closed condition, it is now ready to be opened by inwardly pressing the push tab 42 as previously described above.

The cosmetic case 20 is preferably made of resilient material such as a synthetic resin. The synthetic resin is preferably molded into a unitary two piece construction comprising the base 22 and the cover 24. The synthetic resin preferably has a flex modulus in the range of about 300,000 psi to 350,000 psi. An example of such a material having a flex modulus in the stated range is acrylonitrile-butadiene-styrene (ABS). The movement of the push tab 42, the quick release cam 56, the cover catch protrusions 52 and other relevant parts of the cosmetic case 20 during the opening and closing operations are permitted by the engineering or physical properties of the molded or formed materials that allow them to flex and return to their original state of rest after completion of the opening operation.

To manufacture the cosmetic case 20, first the base 22 and the cover 24 are each injection molded of acrylonitrile-butadiene-styrene (ABS). A pin is then inserted into the hinge 25. A mirror is glued to the cover interior compartment 36 within the inner circular wall 35. A preformed cake of face powder, compact face powder, foundation face powder, eye shadow, or blush is then placed and secured into the base interior compartment 30 within the inner circular wall 29. The cosmetic case 20 is then closed, engaging the base catch indentations 50 with the cover catch protrusions 52.

Although particular embodiments of the present invention have been shown and described, modification may be made to the cosmetic case without departing from the teachings of the present invention. The terms used in describing the invention are used in their descriptive sense and not as terms of limitation, it being intended that all equivalents thereof be included within the scope of the appended claims.

What is claimed is:

1. A case including a cover and a base, the cover and base having end and peripheral walls which together define an interior compartment, the peripheral walls having front and rear portions, a hinge associated with the rear portions of the base and cover peripheral walls rotatably mounts the cover on the base, and a latching device located in the front portion of the case, the latching device comprising:

(i) a resilient push tab in the form of a tongue-like section which is a single integral part of the base peripheral wall, the distal and intermediate portions of said push tab being separated from adjacent portions of the base peripheral wall by at least one slot which extends alongside said push tab to its proximal end;

(ii) coacting cam means for producing a force biasing the front portion of the base and cover apart when the push tab is moved inwardly with the latch device engaged, said push tab including a portion of the coacting cam means and the cover peripheral wall adjacent the push tab including a cooperating portion of the coacting cam means; and (iii) a pair of protrusions integrally formed on the cover peripheral wall and a cooperating pair of indentations integrally formed on the base peripheral wall, said protrusions and said indentations latching the cover to the base when the front portions of the base and cover are pressed together and unlatching when the front portions of the base and cover are forced apart.

2. A case according to claim 1 wherein the base and cover are injection molded of a synthetic resin having a flex modulus in the range of about 30,000 psi to 350,000 psi.

3. A case according to claim 1 wherein the base and cover are injection molded of acrylonitrile-butadiene-styrene.

4. A case according to claim 1 or claim 2 wherein the distal and intermediate portions of said push tab are separated from adjacent portions of the base peripheral wall by two slots, one of which extends along each side of said push tab to its proximal end.

5. A case according to claim 1 or claim 2 wherein the coacting cam means comprises a tab cam and a quick release cam.

* * * * *